United States Patent [19]

McGill et al.

[11] Patent Number: 4,660,637

[45] Date of Patent: Apr. 28, 1987

[54] PACKER AND SERVICE TOOL ASSEMBLY

[75] Inventors: Howard L. McGill, Lufkin, Tex.; Joseph D. Scranton, Tulsa, Okla.

[73] Assignee: Dowell Schlumberger Incorporated, Tulsa, Okla.

[21] Appl. No.: 774,979

[22] Filed: Sep. 11, 1985

[51] Int. Cl.[4] ..... E21B 23/06; E21B 33/128; E21B 33/129

[52] U.S. Cl. ..... 166/120; 166/134; 166/237

[58] Field of Search ..... 166/120, 134, 138–140, 166/122, 123, 125, 237, 196

[56] References Cited

U.S. PATENT DOCUMENTS

| | | | |
|---|---|---|---|
| 2,966,216 | 12/1960 | Bigelow | 166/196 |
| 3,237,695 | 3/1966 | Bostock et al. | 166/134 |
| 3,282,340 | 11/1966 | Park | 166/138 |
| 3,374,837 | 3/1968 | Page et al. | 166/120 |
| 3,552,489 | 1/1971 | Berryman | 166/120 |
| 3,695,352 | 10/1972 | McGill | 166/134 |
| 4,078,606 | 3/1978 | Montgomery | 166/120 |
| 4,393,929 | 7/1983 | Akkerman | 166/134 |
| 4,488,595 | 12/1984 | Akkerman | 166/206 |

FOREIGN PATENT DOCUMENTS

| | | | |
|---|---|---|---|
| 964104 | 10/1982 | U.S.S.R. | 166/120 |

*Primary Examiner*—James A. Leppink
*Assistant Examiner*—Hoang C. Dang
*Attorney, Agent, or Firm*—L. Wayne White

[57] ABSTRACT

A packer and service tool assembly for oil or gas well preparation includes a disengageable coupling mechanism which permits the tool to be screwed into and out of the packer and which can be hydraulically disengaged so that the tool can be removed without applying torque to the tool or workstring. A releaseable ratchet mechanism is also provided in the packer for trapping the setting loads when the packer is set in the casing. The ratchet mechanism is releasable by pulling up a housing portion which cammingly engages collapsible ratchet fingers thereby disengaging the ratchet finger trapping teeth from a stationary ratchet ring.

6 Claims, 20 Drawing Figures

PACKER AND SERVICE TOOL ASSEMBLY

BACKGROUND OF THE INVENTION

1. Technical Field

The invention relates generally to apparatus for preparing a production well such as a gas or oil well. More specifically, the invention relates to a gravel packing system used in a well to place gravel in casing perforations of the well at a formation site.

2. Discussion of Related Art

An oil well borehole which is being prepared for oil and/or gas production generally includes a steel casing supported by a cement casing in the annulus around the steel casing. The cement casing isolates two or more zones such as, for example, a production zone from brine. A number of perforations are formed in the casings at the formations thus providing fluid communication between the formation and the well. A production string wellstring provides a fluid conduit through which the oil or gas travels to the surface. A portion of the production string opposite the casing perforations is referred to as the screen. The screen is made of tubing with numerous holes formed in the tubing wall. Wire is then wrapped around the tubing so as to achieve a desired mesh which permits the formation products to flow up the production string but blocks undesired deposits entrained in the oil or gas.

A serious problem encountered during extraction is the presence of formation sand in the product. Because of the high fluid pressures involved, there is a sandblasting effect on the screen which can quickly lead to premature weardown of the screen and tubing.

A common technique used to overcome this blasting effect of the formation sand is to pack gravel in the casing perforations and in the annulus around the screen. The gravel acts as a trap which blocks the formation sand from reaching the screen but which permits permeability for the product medium such as oil to flow through to the production string.

The gravel is mixed with water and pumped as a slurry down the well to the formation site. The gravel must be effectively packed to prevent voids. When packed under pressure the slurry dehydrates with the fluid being returned to the surface via a washpipe.

The gravel packing process is carried out using a packer apparatus and a service tool. Generally, the packer is an apparatus which in normal use is placed in the well and directs the slurry to flow to the desired location for packing. The packer performs this task by separating the annulus between the string and casing into two sealed off regions, the upper annulus above the packer and the lower annulus which is below the packer. The packer is provided with a plurality of slips which can be hydraulically actuated to bite into the steel casing to support or set the packer in the well hole. A plurality of packer sealing elements are compressed and expanded radially outwardly to seal off the upper annulus from the lower annulus.

The hydraulic actuation of the packer is effected by the use of another tool called the service tool which may also be referred to as a running tool or cross-over tool. The service tool is screwed into the packer and both tools are run into the well with a workstring. The service tool provides a conduit via tubing for hydraulically setting the packer and provides cross-over ports for carrying the slurry from the tubing over into the lower annulus through openings or squeeze ports in the packer housing.

In normal use the service tool is removed from the well after the packing operation is completed and the packer remains set in the well. After the service tool is removed the production string can be run into the well and extraction of the formation products is carried out.

The packer and service tool assemblies known heretofore, however, have numerous drawbacks and very undesirable limitations. For example, because the service tool and packer are screwed together, in order to remove the service tool it must be unscrewed from the packer via the workstring. This procedure requires the application of high torque levels on the workstring in order to rotate and back out the service tool from the packer. This is particularly difficult in highly deviated (curved or nonvertical) wells wherein the torque applied to the workstring is prohibitive.

Another problem with the known packers and service tool is the tendency for the packer assembly to relax when the setting pressure is removed thus reducing the effectiveness of the packer seal elements and the slips which support the packer in the casing.

Another significant problem is that when it becomes necessary to perform a run to retrieve the packer, the packer must be pulled out with a tremendous force necessary to free the packer from the casing due to the high slip load.

SUMMARY OF THE INVENTION

The invention overcomes the above-mentioned problems by providing a service tool which can be hydraulically disengaged from the packer without applying torque to the wellstring or the service tool. The invention broadly contemplates a threaded engagement between the packer and service tool including threaded male and female elements which form a screw-in type coupling but in which the coupling elements can be disengaged hydraulically without unscrewing one element with respect to the other.

Another aspect of the invention is a threaded coupling which holds the service tool and packer together such that the tool and packer can be run into the well as an assembled unit with a workstring. The coupling can be hydraulically disengaged to permit a torqueless separation of the service tool from the packer by means of a cooperating lock ring and piston assembly which in one position maintains the threaded coupling elements in an engaged configuration and which in a second position permits the coupling elements to fully disengage. Thus, the packer and service tool can be either hydraulically separated by disengaging the coupling or conventionally separated by unscrewing the tool from the packer.

The invention further contemplates a ratchet mechanism for maintaining seal integrity and slip load between the packer and casing after the setting pressure is removed. The ratchet mechanism can be selectively disengaged to permit a substantial reduction in the slip load to facilitate removal of the packer after setting.

These and other aspects of the present invention will be fully described in and understood from the following specification in view of the accompanying drawings.

BRIEF DESCRIPTION OF THE DRAWINGS

FIG. 6A is an exploded view of a ratchet mechanism according to the present invention;

FIGS. 6B and 6C are enlarged views of trapping teeth on a ratchet sleeve and T-shaped ratchet ring; and FIG. 6D is a partial plan view of the ratchet ring shown in FIG. 6A showing a split ring design.

DETAILED DESCRIPTION OF THE DRAWINGS AND THE PREFERRED EMBODIMENT

Figure 1:
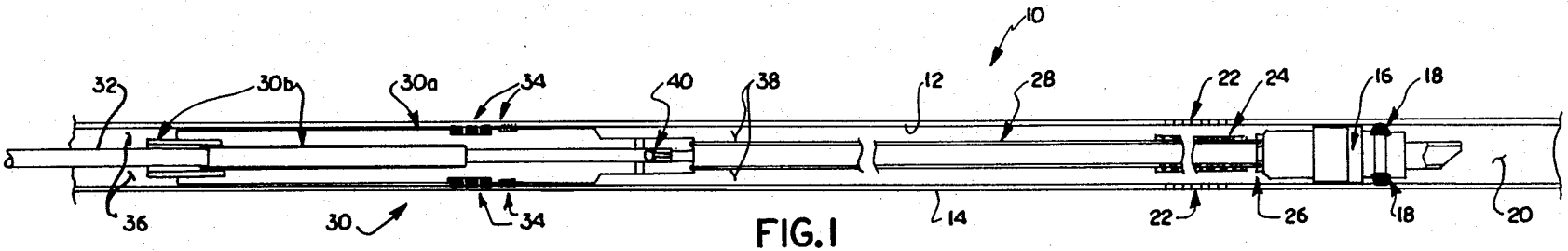
FIG. 1 is a schematic view in longitudinal section of a portion of a typical well showing the relative locations of various features of the well and a set packer and service tool assembly used in the well.

Referring to FIG. 1, a lower portion of a well hole being prepared for producing oil and/or gas from a formation (not shown) is generally indicated by the numeral 10. In a typical well, a formation may be 10,000 feet or more below the earth or water surface. The well 10 is defined by a steel casing 12 supported within the borehole (not shown) by a cement casing 14. The cement casing 14 both supports the steel casing 12 and also is used to isolate productive zones from brine, salt water and/or other subsurface formations. Hereinafter the term "casing" will be used to generally refer to the steel casing/cement casing structure 12, 14.

A conventional sump packer 16 is run down into the well 10 to a location a few feet below the anticipated production formation. The sump packer 16 is set in the casing with a plurality of hydraulically actuated slips and packer seal elements generally indicated by 18 and thus seals off the annulus above the sump packer 16 from the rathole 20. After the sump packer 16 is set in the well 10, perforations or holes 22 (shown schematically in FIG. 1) are blown, using explosive charges, through the casing at the formation. The perforations 22 open the well 10 to the formation to permit production of the formation products.

A conventional screen 24 is positioned opposite the perforations 22 and is sealingly engaged with the sump packer 16 by a stinger 26. The stinger 26 prevents gravel from falling through the sump packer. A non-perforated blank liner or tubing 28 extends above the screen 24 to a packer and service tool assembly 30. The assembly 30 includes generally a packer **30*a* and a service tool 30*b*. A workstring 32 is connected to the top end of the tool 30*b* and runs up to the surface (not shown). In a typical well, the assembly 30 is positioned about one hundred feet or so on the average above the perforations 22. The sump packer 16 acts as a base support for the stinger 26, screen 24, blank 28 and packer assembly 30** to sit on.

It should be apparent that the configuration of the well 10 illustrated in FIG. 1 is such as it would be just prior to performing a gravel packing job. After the gravel packing is completed, the service tool portion **30*b* of the assembly 30 is removed (as will be described hereinbelow) via the workstring 32 and the packer portion of the assembly 30 remains in the casing. The packer 30*a* above the perforations 22** has a very smooth central bore in its housing into which a production string (not shown) is stingered as will also be more fully described later.

The packer **30*a* is set into the casing by a plurality of packer seal elements and slips generally indicated by members 34 which will be more clearly illustrated in other drawings herein. Thus, as shown, the assembly 30 separates the well 10 into an upper annulus 36 above the packer 30*a* and a lower annulus 38 below the packer 30*a*. The assembly 30 is used to pump gravel in the form of a slurry (not shown) into the lower annulus 38 via squeeze ports 40. Since the assembly 30 seals off the lower annulus 38 from the upper annulus 36, the slurry is constrained to flow to the perforations 22. The slurry is packed into the perforations 22 and the annulus surrounding the screen 24. The gravel is packed to ensure there are no voids, with the dehydrated fluid being returned to the surface by a washpipe (not shown) or other suitable means for disposal. The gravel is also packed into the entire annulus around the blank liner 28 up to the ports 40. The blank liner 28** provides a reservoir of gravel if settling occurs at the screen after the packing operation. Such settling can occur, for example, due to incomplete dehydration of the slurry during packing. The reservoir of gravel thus prevents any voids around the screen and ensures that the screen is covered.

The just-described gravel packing technique is commonly referred to as squeezing. While the preferred embodiment is shown and described with particular reference to this technique, the present invention is not limited to the squeeze technique. Other packing techniques may be used. For example, if long intervals are being used (i.e. long perforation zones) a circulating technique can be used for packing the gravel. Such packing techniques are well known in the art and do not constitute a part of the present invention. Furthermore, the present invention is directed to an improved coupling between the service tool **30*b* and the packer 30*a* as well as an improved means for setting the packer 30*a* in the casing. Thus, the invention can be used with other packers, such as for example the sump packer 16**, and is not necessarily limited to use with the particular gravel packer exemplified herein.

The gravel pack integrity can be checked by applying pressure via the workstring 32 and ports 40 after reversing circulation. If a predeterminable pressure is held, the pack is considered good and the workstring 32 and service tool **30*b* are removed and the production string run into the well 10** and stingered in the packer bore as described. A reverse circulating process is run prior to the pack integrity test as will be described herein.

The various features of the packing system described thus far such as running in the hole, formation of the casing and perforations, the screen, blank liner, and packing operations performed by use of the assembly 30 can all be accomplished by methodologies well known to those skilled in the art, the present invention being directed to particular features of the packer and service tool assembly.

Figure 2A:
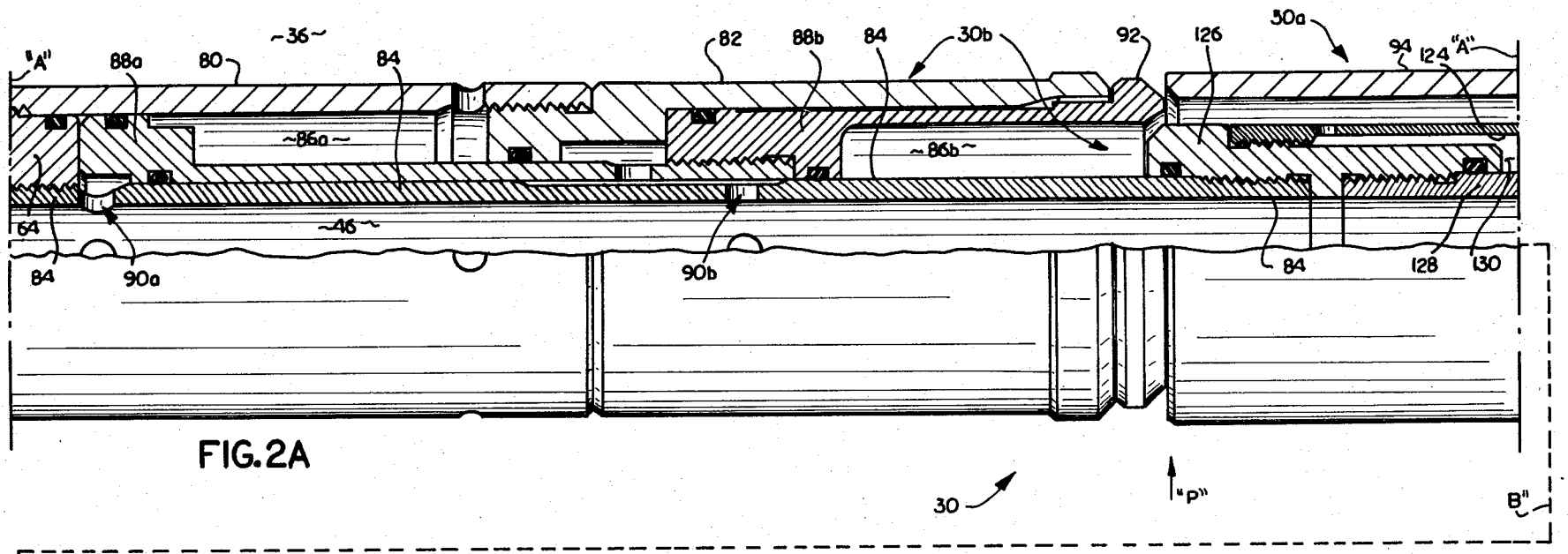
FIGS. 2A–2F are partial longitudinal section views of a packer and service tool assembly during running in the well hole.

The remaining FIGS. 2A through 6 show detailed views of various portions of the packer and service tool assembly 30 and hence the casing, blank liner, and most of the workstring 32 are omitted for clarity. Because the packer and service tool are rather substantial in length, in order to maintain sufficient detail in the drawings, certain longitudinal portions of the packer 30*a* and the service tool 30*b* have been omitted since they need not be shown to fully understand the instant invention. These omitted portions are, of course, represented by the break lines (such as the lines designated "A" in FIGS. 2A, 2C), and the dashed lines (such as the line designated "B" connecting FIGS. 2A and 2B) indicate longitudinal axial alignment. Continuations between drawing sheets are corresponded by the encircled A and B. The omitted longitudinal portions are simply continuing segments of the structure otherwise illustrated. As viewed from left to right in the figures, the packer and tool assembly 30 extends or runs through the well 10 downwardly. For example, the section shown in FIG. 2A is above the section shown in FIG. 2B with respect to the longitudinal axis of the well.

Turning now to FIGS. 2A–2F, the packer and service tool are shown as an assembled unit 30 when running in the hole or well. The packer 30*a* includes a generally cylindrical multi-section housing 50. A lower portion of the housing 50, parts of which are shown in FIGS. 2C–2F, comprises a plurality of extension members 52 joined together in endwise alignment by threaded collars 54. O-ring type seals 55 may be provided as needed. The bottom end of the housing 50 is threadedly coupled in a known manner to the blank liner 28 (FIG. 1). An uppermost extension of the housing 50 (FIGS. 2C, 2D) is a ported housing member 52*a* which is threadedly engaged with a lower section or coupling 56 which joins the ported housing 52*a* to a lower setting housing 58 and a packer mandrel 60. The lower section or coupling 56 is joined to the lower housing 58 by a plurality of packer release shear bolts 62 (only one shown) and is threadedly engaged to the packer mandrel 60. The lower section 56 may have other configurations or structure. The packer mandrel 60 is coupled to the service tool 30*b* by a disengageable tool release coupling 100 (FIG. 2B) which will be more fully described hereinafter. For now it will suffice to understand that the service tool 30*b* has an upper end or sub 64 (see FIG. 2A for partial view) which is coupled in a known manner to the workstring 32 (FIG. 1). Thus, during running in the hole, the screen load and blank liner weight is carried via the packer mandrel 60 and the service tool coupling 100 to the workstring 32.

It should be noted at this time that the service tool 30*b* is axially slideable within the packer 30*a* whenever the coupling 100 is disengaged. The relative axial position of the service tool with respect to the packer is controlled either by engaging the coupling 100 (referred to as the squeeze position) or with a series of collet indicators which will be described later herein.

During running in, the packer 30*a* and service tool 30*b* are coupled together as an assembled unit 30. For the most part, the service tool 30*b* is a generally cylindrical shaped tool which runs axially through the inner cylinder of the packer 30*a* and is eventually removed therefrom at the completion of a gravel pack job. However, a portion of the tool 30*b* does extend above the packer to the workstring 32, which portion is substantially shown in FIG. 2A. Precisely, the packer 30*a* extends up to the region designated "P" in FIG. 2A. The assembly 30 is effected by screwing the service tool 30*b* into the packer 30*a* via the disengageable coupling 100.

Figure 2B:
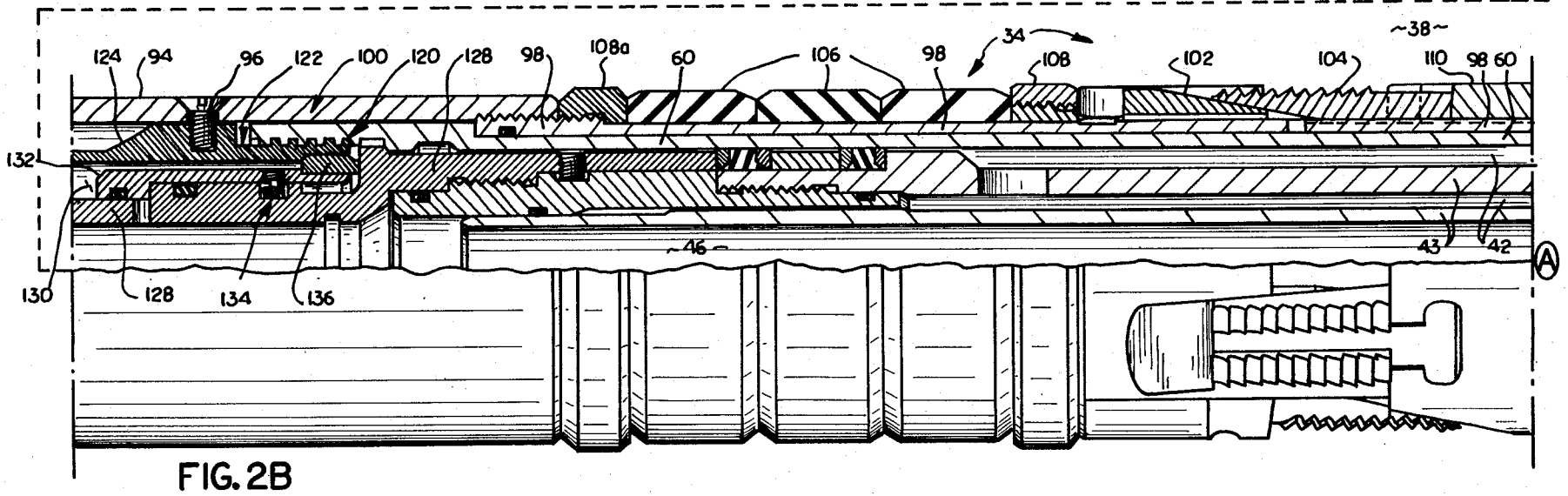
Figure 2C:
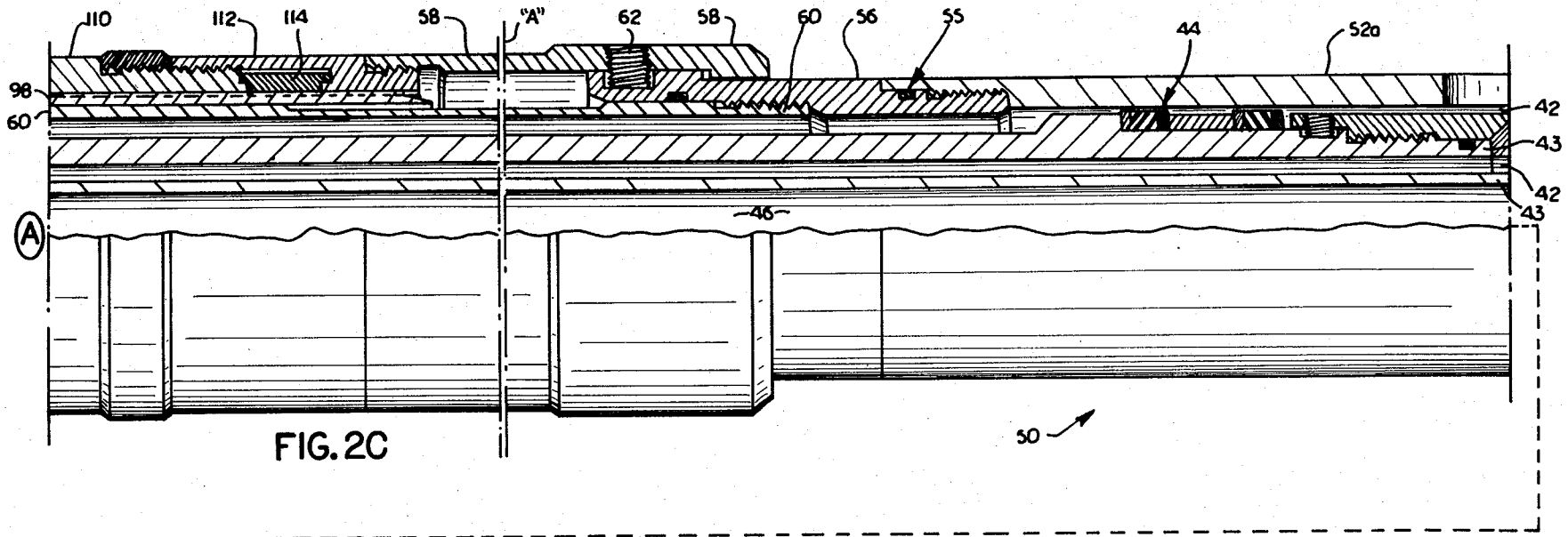
Figure 2D:
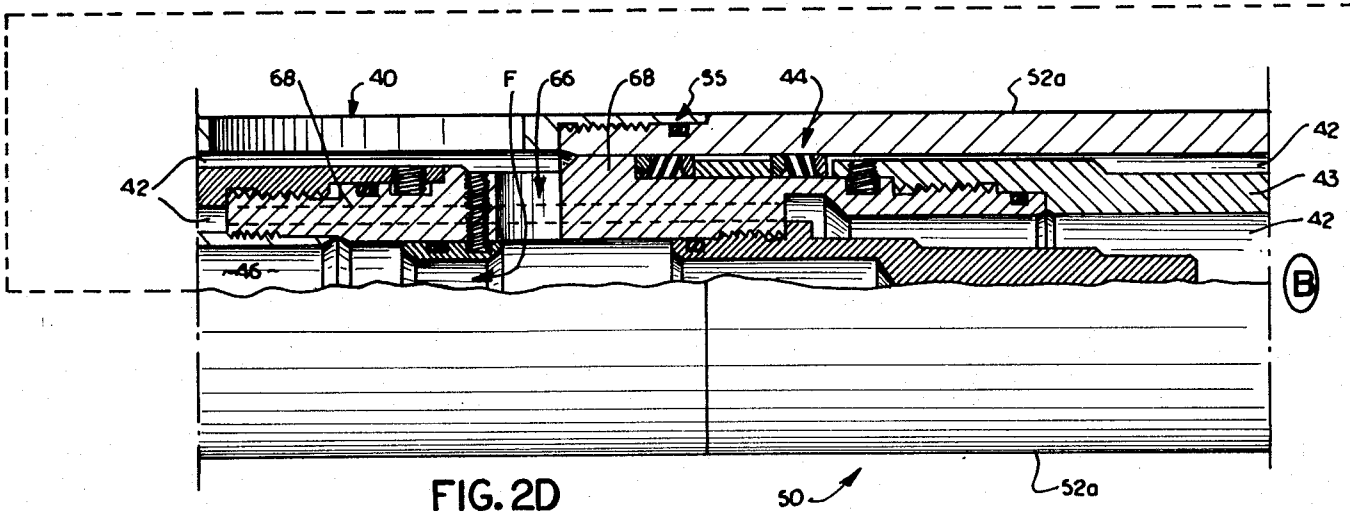
Figure 2E:
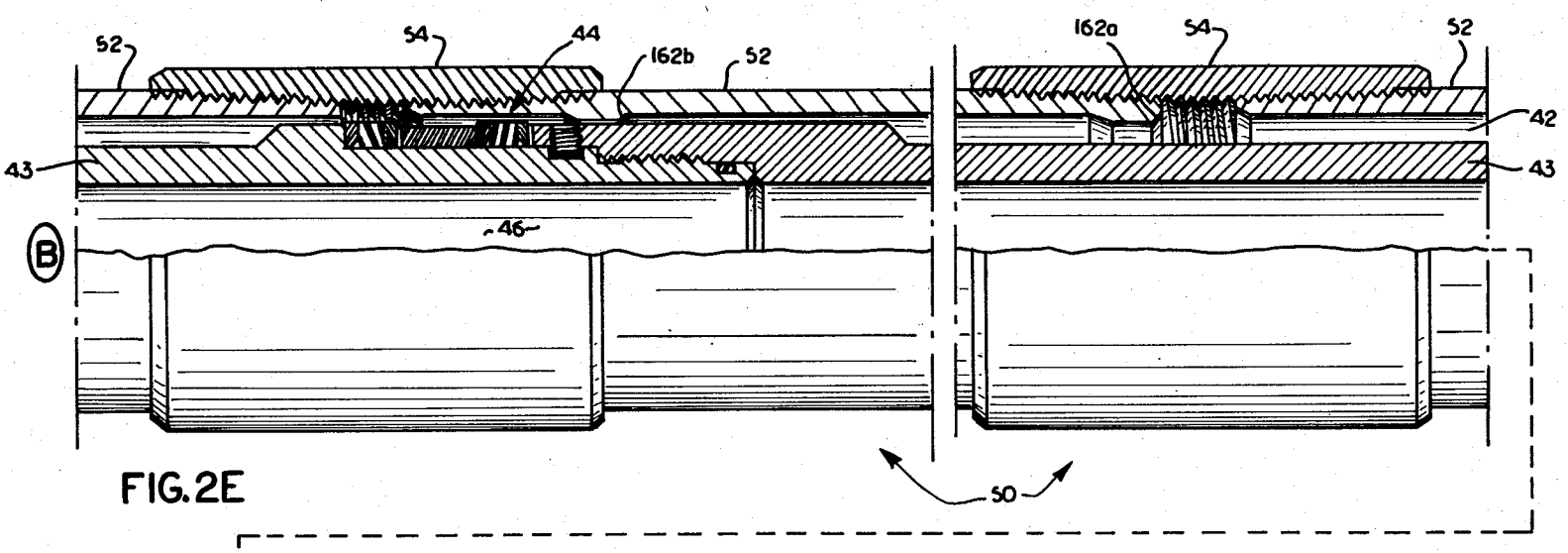

As is most clearly shown in FIGS. 2C and 2E, because the service tool runs axially within the packer, a number of annuli 42 can be provided to direct and control the flow of fluids, slurries and so forth within the well 10. Such may be particularly desirable when a circulating technique is used for gravel packing. The flows which occur within the assembly 30 can be designed in a known manner using, for example, seal and sleeve assemblies 44. The annuli or fluid paths 42 can be provided in a known manner by a plurality of service tool sleeves and mandrels 43, which can run, using extensions, part or all of the length of the service tool 30*b*.

Also, the workstring 32 provides a fluid conduit to the assembly 30. A central fluid passage 46 extends through the service tool and is referred to as the tubing. The tubing is, of course, in fluid communication with the workstring via the sub 64. The rig equipment at the surface above the well 10 can pressurize the tubing 46 as well as the upper annulus 36 (FIG. 1). Pressure is supplied to the lower annulus 38 via the ports 40 which will be described shortly.

The assembly 30 and the blank liner 28, the screen 24 and the stinger 26, are run into the well using the workstring 32 until the stinger tags (i.e. mates and seals) the upper end of the sump packer 16. This is the general positioning shown in FIG. 1 (keeping in mind, though, that FIG. 1 more specifically shows the packer as already being set in the casing).

Upon reaching setting depth the workstring 32 is slacked off against the sump packer 16 which acts as a supporting base for the packing system.

Referring now to FIG. 2D, a portion of the assembly 30 is shown which includes the squeeze ports 40 in the packer ported housing 52*a* referred to hereinabove, (only one shown in FIG. 2D). During the running in phase, the service tool tubing 46 is in fluid communication with the squeeze ports 40 by way of a cross-over port 66. The port 66 is provided by a mandrel 68 in the service tool. Thus, casing fluid is free to flow into the tubing 46 during running in as indicated by the arrow "F". The axial position of the service tool 30*b* relative to the packer 30*a*, shown in FIG. 2D, is referred to as the squeeze position since it is the same position used when the squeeze technique is used to pack the gravel and is the lowest position of the tool due to the packing system bottoming out against the sump packer 16 when running in. As described earlier, the tool 30*b* is held in the squeeze position during running in because the coupling 100 is engaged. That is, during running in the well, the service tool 30*b* normally remains screwed into the packer 30*b*.

Turning now to FIGS. 3A–3D, when the sump packer 16 is tagged, the procedure for setting the packer 30*a* is begun. A setting ball 70 (about $\frac{7}{8}''$ diameter) is dropped into the workstring 32 and falls down through the tubing 46 and settles in a ball seal 72 located in the tubing 46 just above the cross-over port 66 (see FIG. 3D). The ball seat 72 is a ring-like element which includes a dish shaped surface 74 facing upwardly. The surface 74 is so shaped to permit the ball 70 to settle securely therein to form a ball valve fluid tight seal. An O-ring 76 is provided to seal the interface between the ball seat 72 and the tubing wall of the mandrel 68. After the ball 70 settles into the seat 72, the tubing 46 is cut off from the cross-over port 66 and also the lower annulus 38. A set of ball seat release shear screws 78 (only one shown in the drawings) are shouldered into the ball seat 72 and the ported mandrel 68 to prevent axial displacement of the ball seat 72 with respect to the tubing 46 until sufficient pressure is built up in the tubing to shear off the screws 78. During the packer setting procedure, the ball seat 72 remains in the position shown in FIG. 3D because the tubing 46 pressure is maintained below that which is required to shear off the screws 78 (approximately 3,000 psi).

Figure 3A:
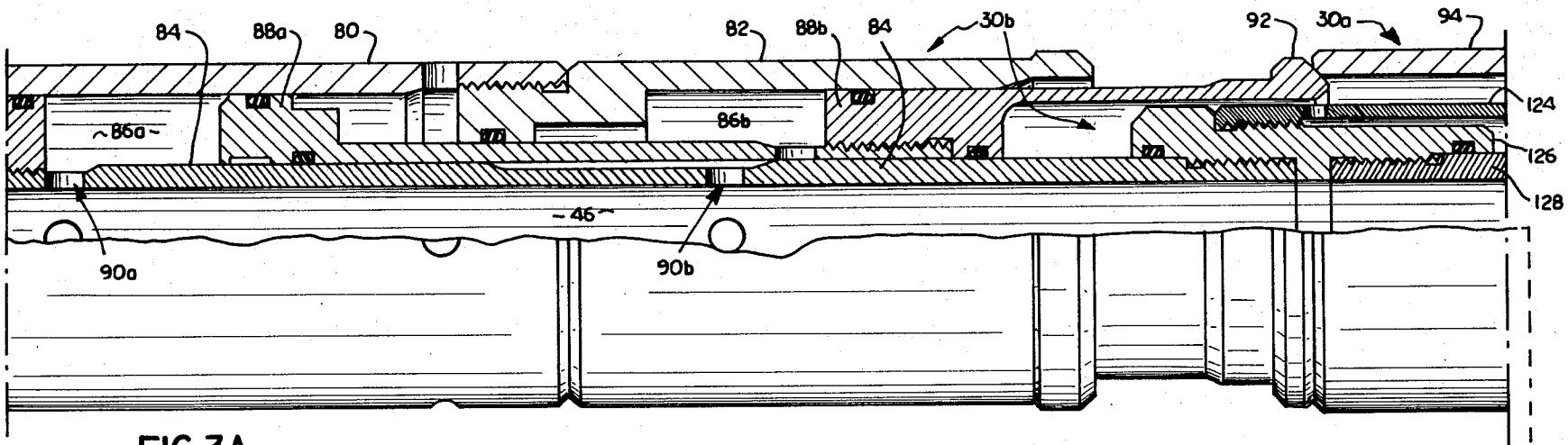
FIGS. 3A–3D are partial longitudinal section views of the packer and service tool assembly shown in FIGS. 2A–2F after setting the packer.

Referring now to FIGS. 2A and 3A, the service tool **30*b* includes an upper setting housing 80 threadedly joined to a lower setting housing 82. The housings 80, 82 in combination with a piston mandrel 84 provide dual piston cylinders 86*a* and 86*b* respectively. An upper setting piston 88*a* is slideably mounted in the upper cylinder 86*a* and a lower setting piston 88*b* is slideably mounted in the lower cylinder 86*b*. The pistons 86** *a,b* are threadedly joined together in tandem endwise alignment.

Prior to setting the packer **30*a* in the casing, the pistons 88*a,b* are positioned up as shown in FIG. 2A. After the settihg ball 70 has sealed, the tubing 46 is isolated from the annulus around the assembly 30 and the tubing pressure is slowly increased up to about 1,000 psi. This fluid pressure acts on the unbalanced upper piston surfaces via cylinder inlet ports 90*a* and 90*b*. The pressure buildup in the cylinders 86*a,b*** forces the pistons to move downwardly (left to right as viewed in FIGS. 2A, 3A) in tandem.

The lower setting piston **88*b* has an annular bead 92 which engages the upper end of a packer setting sleeve 94 and the tandem pistons exert a downward setting force on the sleeve 94** as the tubing pressure increases.

A plurality of flathead screws 96 (only one shown) holds the setting sleeve 94 axially stationary with respect to the service tool **30*b* to prevent compression of the packing members 34 should the packer 30*a* have to be pulled out of the hole before setting (see FIG. 2B). The screws 96 also prevent the service tool 30*a* from unintentionally backing out or unscrewing from the packer 30*b* during running in by locking the coupling 100 to the setting sleeve 94**.

At a predeterminable pressure below 1,000 psi, the screws 96 shear off and the setting sleeve 94 moves downward under the force of the pistons **88*a,b* (see FIG. 3B). The setting sleeve 94 is threadedly joined to a packer ratchet sleeve or mandrel 98 which slides axially downwardly with the sleeve 94. Movement of the sleeve 94 in turn causes downward movement of an upper slip bowl 102 which expands a plurality of slips 104 radially outwardly which bite into and engage with the casing. Continued application of tubing pressure then causes compression of the packing seal elements 106 which are squeezed radially outward into engagement with the casing. The packing seal elements 106 are positioned between a pair of hard elements 108. The upper hand element is designated 108*a* and is threaded onto the ratchet sleeve 98 as illustrated. The elements 108 ensure proper compression of the packing elements 106**.

Figure 3B:
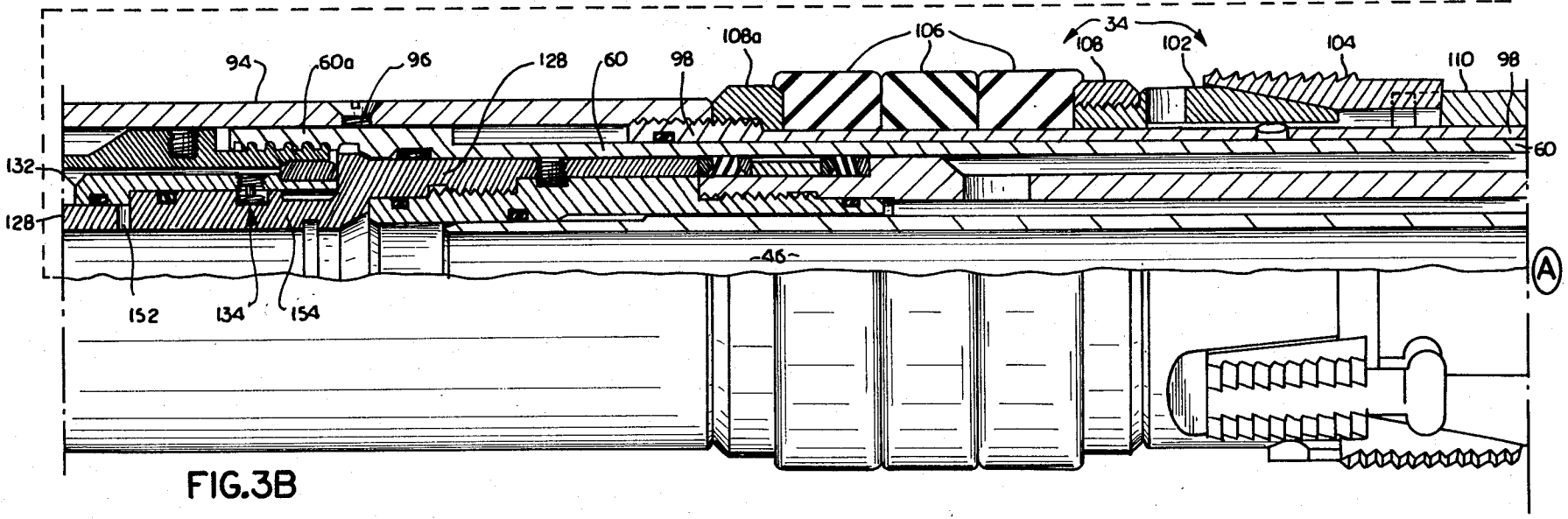
Figure 3C:
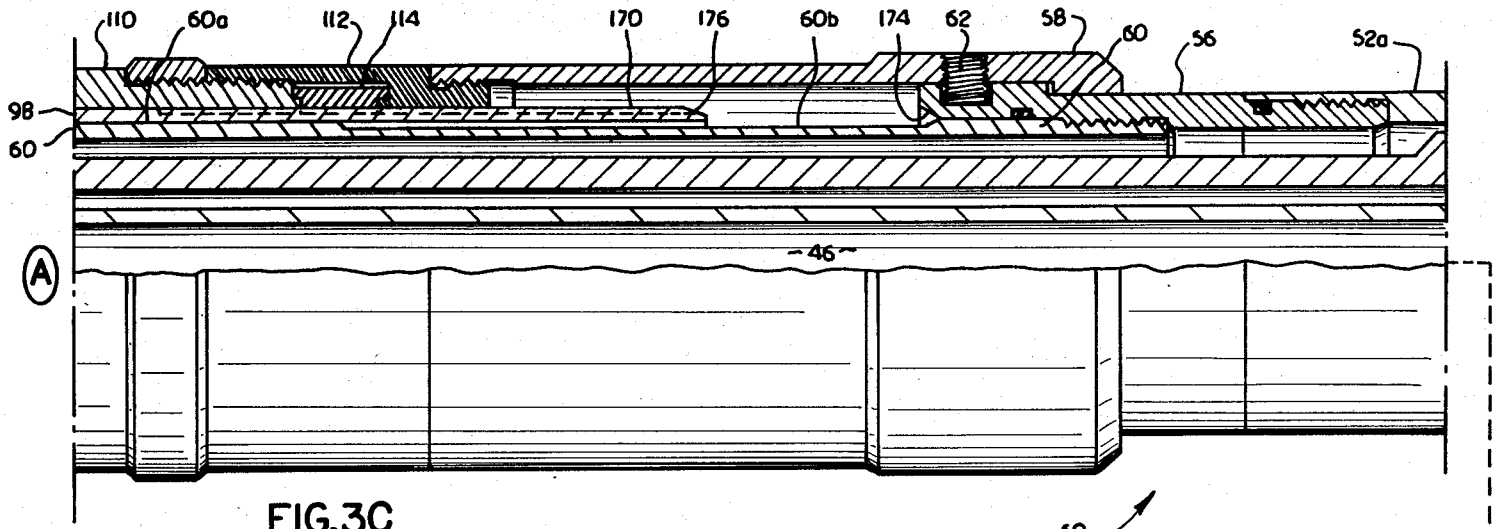

The described downward movement of the pistons 88, sleeve 94, mandrel 98, and slip bowl 102 continues until they are in the position illustrated in FIGS. 3A, 3B and 3C. It should be remembered that FIGS. 2A, 2B and 2C show the initial positions of these setting members prior to applying setting pressure to the tubing 46.

By increasing the tubing pressure slowly up to 1,000 psi, initially the slips 104 expand out followed by compression of the packer elements 106. The pistons **88*a,b* have a combined unbalanced differential area of about 22 square inches so that a tubing pressure of 1,000 psi results in an initial setting load of about 22,000 pounds. This load is held for 10 minutes after which the tubing pressure is increased slowly to 1,500 psi or a setting load of about 33,000 pounds. This load is adequate for intially setting the slips 104 into the casing and ensuring a good seal between the packer elements 106 and the casing. This seal, as described before, separates the upper and lower annuli 36, 38** (FIG. 1).

Downward movement of the slips 104 during setting is prevented by a lower slip bowl 110. The lower slip bowl 110 is restrained against downward movement because it is coupled to the lower setting housing 58 which is joined to the packer mandrel 60 via the lower coupling 56 and packer release screws 62 as described hereinbefore. Since the packer mandrel 60 cannot move downward due to its being coupled to the workstring 32 via the disengageable coupling 100, the slips 104 and elements 106 expand radially outwardly as described. The lower slip bowl 110 is joined to the lower setting housing 58 by a ratchet ring housing 112. Thus, the setting load is actually a compressive force applied via the pistons **88*a,b* to the elements and slips 106, 104 and opposed by the lower housing 58 and mandrel 60 joined to the workstring 32**.

By comparing FIGS. 2A, 2B and 2C with FIGS. 3A, 3B and 3C, the movement of the setting members should be straight forward. Note that the packer releasing screws 62 must resist any setting load applied to the slips 104 and elements 106. The screws 62 are selected not to shear except under a packer release workstring pull load of 65,000–70,000 pounds above the pipe weight.

After the setting load of 1,500 psi has been held for about 10 minutes the tubing pressure is bled off and the packer setting can be tested. A pull test is performed by applying an upward load on the workstring (referred to as "picking up" the workstring) of 5,000–10,000 pounds over the pipe weight (a total of about 60,000 pounds). If the weight load is maintained the setting is considered acceptable. If the test fails the tubing pressure can be reapplied to attempt to set the packer **30*a*** again.

The packer seal elements 106 seal integrity is also checked by applying about 1,000 psi to the upper annulus 36 and verifying the pressure holds.

Though the ratchet mechanism will be described in greater detail herein below, it should be noted now that after the setting pressure is bled from the tubing 46, the loads of the packing elements 106 and slips 104 are trapped between the casing, the ratchet sleeve 98 and a ratchet ring 114 (see FIGS. 3B, 3C). The ratchet ring 114 prevents upward movement of the ratchet sleeve 98. This prevents relaxation of the packing members 104, 106 in the packer **30*a*** when the setting pressure is bled off.

Once the packer **30*a* is properly set into the casing, the packer is essentially ready for beginning a gravel packing job; however, first the service tool 30*b* must be disengaged or released from the packer 30*a* so that after the gravel pack job is completed, the tool 30*b* can be removed from the well. As discussed hereinabove, known service tools must be unscrewed from the packer which can be very difficult due to high torque on the workstring 32 in a highly deviated well. The present invention completely overcomes this serious problem by providing a means for hydraulically disengaging or releasing the coupling 100 so that the tool can be removed from the packer without torqueing the workstring. Thus, a simple torqueless upward pull on the workstring can be used to remove the service tool 30***b* after the gravel packing operation is completed.

The coupling 100 is used to screw the tool 30*b* into the packer 30*a* and hold them together as a unit during running in and packer setting. The shear bolts 96 prevent accidental unscrewing of the tool 30*b* during running in as described earlier herein. Referring to FIGS. 2A and 2B, the coupling 100 includes a packer female member 120 on the upper end of the packer mandrel 60. The packer mandrel 60 extends downward and is joined to the lower coupling 56 thus locking the tool 30*b* to the packer housing 50 when the coupling 100 is engaged. The service tool 30*b* includes a male member 122 on the lower end of a threaded setting collet 124. The male and female members 122, 120 have complementary threads which cooperate to hold the coupling members together in a screw-like manner as illustrated. The collet 124 is threadedly engaged with a collet sub 126 (FIG. 2A) which in turn is engaged with the upper piston mandrel 84. As described earlier herein, the mandrel 84 is coupled to the workstring 32 via the sub 64. Thus, when engaged, the coupling 100 forms a positive engagement between the service tool 30*b* and the packer 30*a* to form the assembly 30. The assembly 30 as a unit can be run into the well by the workstring 32 and the screws 96 prevent disengagement.

Still referring to FIGS. 2A and 2B, the collet sub 126 is also threadedly engaged with a lock piston mandrel 128. The mandrel 128 cooperates with the setting collet 124 to support a release lock piston cylinder 130 which slideably houses a generally cylindrical release lock piston 132. During running in and packer setting the lock piston 132 is prevented from axially sliding upwards by a pair of shear screws 134 (only one shown) which threadedly engage the piston 132 and the lock piston mandrel 128.

The lower end of the piston 132 carries a release lock ring 136 which is expanded by the piston 132 and engages the male member 122 so as to hold the male release threads engaged with the female release threads on the female member 120.

Figure 4A:
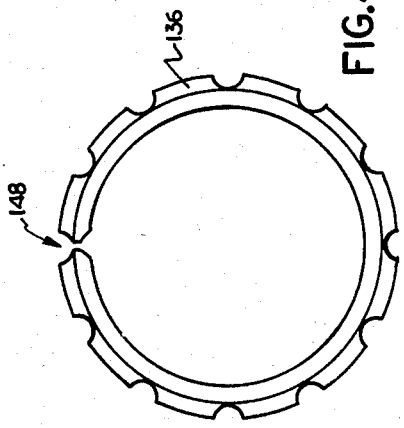
FIG. 4A is a plan view of a relase lock ring used in the threaded coupling shown in FIG. 4.
Figure 4B:
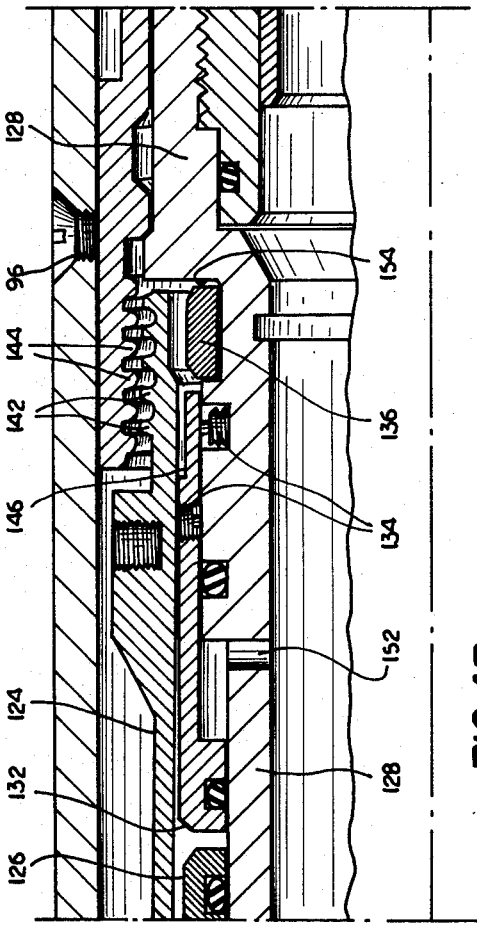
FIG. 4B is a longitudinal section of a portion of the packer and service tool assembly showing disengagement of the threaded coupling used to hold the service tool and packer together as an assembly while the assembly is running in the hole.
Figure 4:
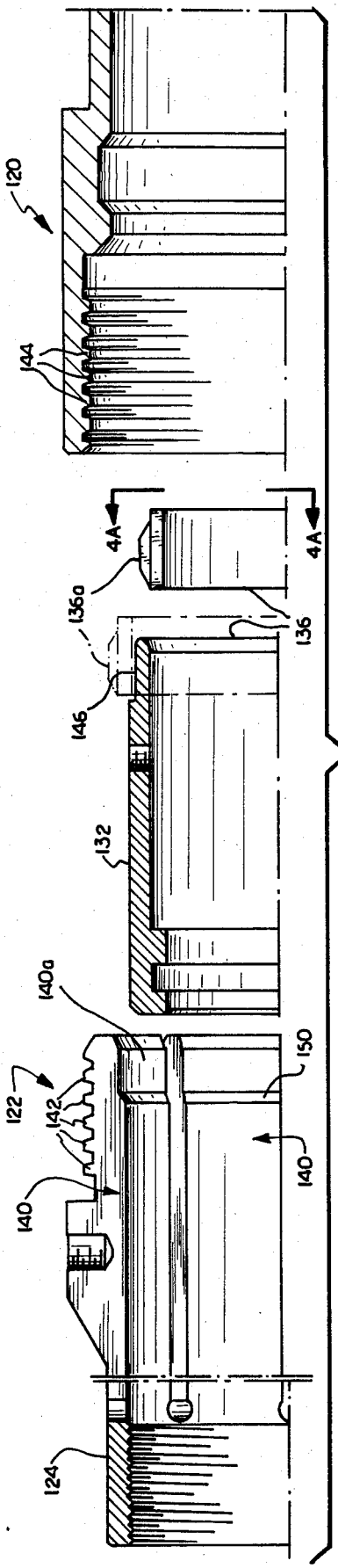
FIG. 4 is an exploded view of a threaded coupling according to the present invention prior to disengagement.

The design of the coupling 100 is more clearly shown in FIG. 4. The male end 122 of the collet 124 has a plurality of slotted arcuate collet fingers 140 (only two shown). The outer periphery of the fingers has the release threads 142 thereon which engage mating release threads 144 on the female member 120 in a screw-like manner. The collet fingers 140 are designed so that they normally relax in a radially inward position and do not engage the female threads.

The release lock piston 132 is positioned within the collet 124. The release lock ring 136 is expanded to slide onto a recess 146 on the lower end of the piston 132, as shown in phantom in FIG. 4. When so expanded, the ring outer perimeter 136*a* engages a recessed inner surface 140*a* of the collet fingers 140. This keeps the male release threads 142 expanded and engaged with the female release threads 144 as long as the piston 132 is in the position shown in FIG. 2B. As shown in FIG. 4A the ring 136 is split as at 148 to permit the ring to be expanded onto the piston recess 146. A shoulder 150 on each finger 140 is provided just above the recess area 140*a* and engages an upper edge 136*b* of the expanded ring 136 when the piston 132 slides upwardly (right to left as viewed in FIG. 4) to a release position shown in FIG. 4B.

Figure 3D:
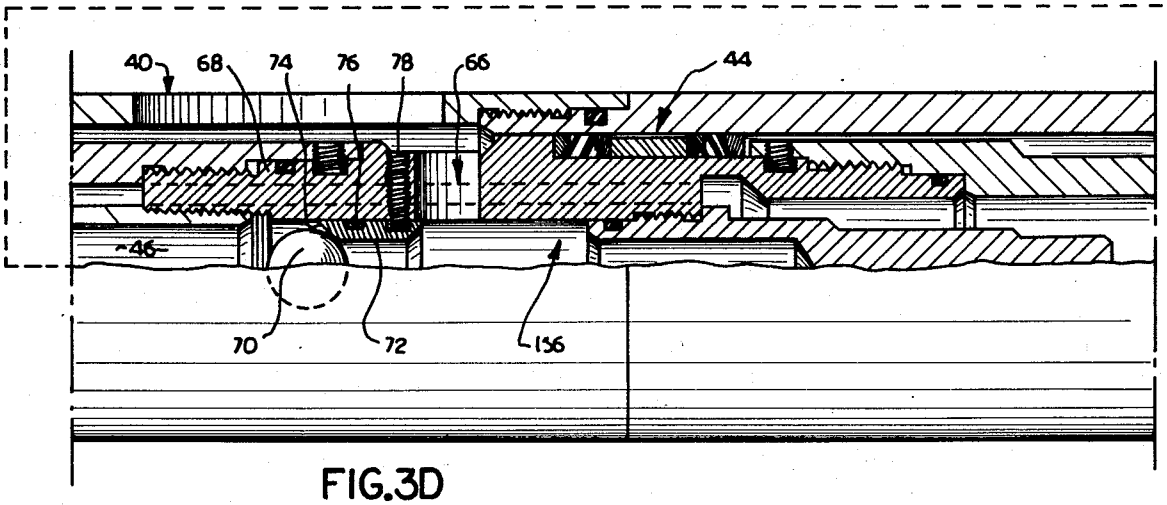

Referring now primarily to FIGS. 4B and 3B, operation of the releasing means which includes members 132, 136, 140 so as to facilitate disengagement of the coupling 100 will now be described. It should be remembered that prior to releasing the tool 30*b* from the packer 30*a* the packer has been set into the casing and the ball 70 is still seated so as to isolate the tubing 46 from the annulus (see FIG. 3D).

Tubing pressure is increased through the workstring 32 and applies an upward force on the piston 132 via an inlet port 152. The shear bolts 134 are designed to break at a tubing pressure of about 2,000 psi. When the piston shifts upward to the release position shown in FIG. 4B, the lock ring 136 slides off the recess 146 and collapses into a recess 154 in the lock piston mandrel 128. This permits the fingers 140 to relax away from and out of engagement with the female member 120 as shown in FIG. 4B. The disengaged coupling thereby permits the service tool 30*b* to be simply pulled out of the packer with a torqueless pickup of the workstring 32. Thus, the tool 30*b* can be removed from the packer 30*a* without unscrewing it even in a highly deviated well.

It should be noted that the coupling 100 design also has the desirable backup feature that permits the service tool to be unscrewed from the packer should the hydraulic decoupling fail for some reason to operate. A test can be performed to verify hydraulic disengagement of the tool and packer by bleeding off the tubing 46 pressure and picking up the workstring 32 to pipe weight. The pipe weight should decrease by the weight hanging below the packer.

Another important feature of the hydraulic release is that as the tubing pressure is increased to 2,000 psi to shear the bolts 134, this same pressure further sets the packer 30*a* into the casing up to a load of about 44,000 pounds. This is, of course, due to the fact that with the coupling 100 engaged the setting pistons 88*a*, *b* still act to expand the packer elements 106 and slips 104 as described earlier herein.

The hydraulic release of the service tool 30*b* also permits disengagement without applying undesirable stress or torque to the set packer.

Of course, when the tool 30*b* has been released from the packer 30*a* it is normally not yet removed from the well since the gravel packing operation still has yet to be completed.

After the service tool 30*b* has been released from the packer 30*a* by disengagement of the coupling 100, the setting ball 70 must be moved so as to unblock the crossover port 66 to permit fluid communication between the tubing 46 and the annulus 38.

Figure 5:
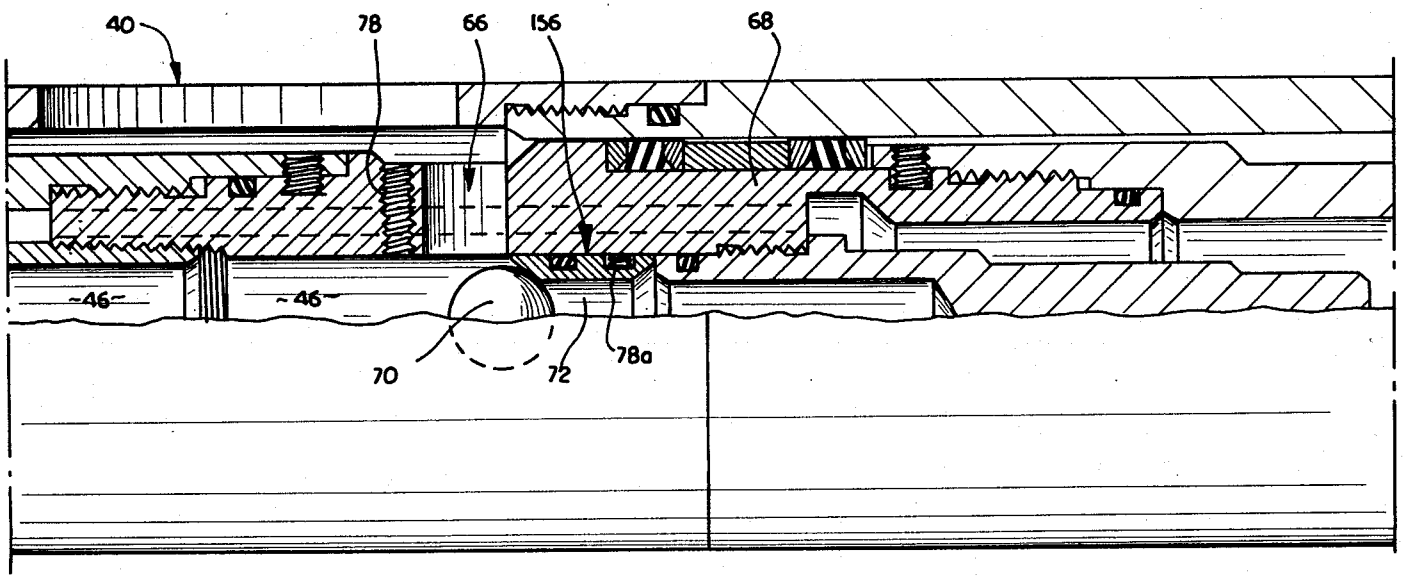
FIG. 5 is a longitudinal section of a portion of the packer and service tool assembly just prior to performing a gravel packing operation by a squeeze technique, specifically showing a cross-over port and ball check valve between the tubing and the annulus.

Referring to FIGS. 3D and 5, this step is accomplished by pressurizing the tubing 46 to about 3,000 psi. This pressure is sufficient to shear off the ball seat release shear screws 78, a portion 78*a* of which remains in the seat 72. When the screws 78 break, the ball 70 and seat 72 slip down into a recess 156 in the ported mandrel 68. Release of the ball and seat check valve type assembly is immediately verified by a drop in tubing pressure as the ball goes past the port 66 since the annulus 38 and tubing 46 are now in communication via the port 66.

Note that the pressure applied to pump the ball seat 72 and ball 70 down does not act to release the packer 30*b* since the service tool 30*a* and workstring 32 are no longer connected to the packer 30*b* and therefore no load is applied to the packer release shear screws 62.

It should be noted that three distinct and predeterminable tubing pressures have been discussed herein. The first, at about 1,000–1,500 psi, is used to initially set the packer 30*a* without releasing the tool 30*b*. The next tubing pressure is about 2,000 psi which further sets the packer until the tool release piston 132 moves thereby disengaging the coupling 100. The third pressure is about 3,000 psi which releases the ball 70 and ball seat 72. These pressures are predeterminable, of course, by appropriate selection of the shear bolts 78, 96 and 134 to result in the desired shearing pressure.

When the squeeze packing technique is used, the service tool 30*a* is in the squeeze position because the packing system members are bottomed out and the workstring can also support the service tool. In any event, the gravel pack slurry is pumped down the workstring 32 through the tubing 46, and passes out the squeeze ports 40 and the packing procedure is performed as described before.

Figure 2F:
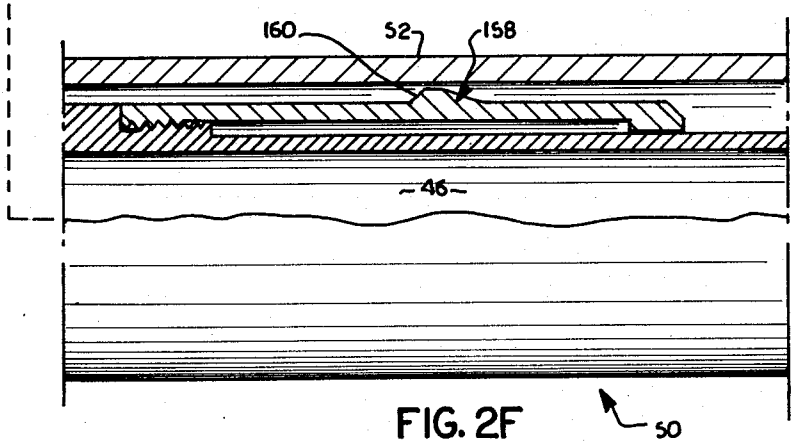

Referring now to FIGS. 2E and 2F, when a circulating packing technique is to be used (such as when long casing perforation intervals are necessary), the circulating positions of the tool 30*b* with respect to the packer 30*a* are located by known techniques using collet indicators. A collet indicator 158 is shown in FIG. 2F. This member presents a cam surface 160 which engages position indicators 162*a*, 162*b* when the workstring 32 is used to pick up the tool 30*b*. The position indicators 162 are simply recesses in the packer housing which engage the collet indicators. In order to move the service tool to a different circulating position a sufficient force must be applied to overcome the cam engagement. It should be apparent that the circulating positions can be located by relative axial movement of the tool 30*b* within the packer housing 50 after the coupling 100 has been disengaged.

After the gravel packing job is completed a reversing circulation is performed by pressurizing the upper annulus 36 and slowly picking up the service tool 30*b* until the ports 66 are opposite the upper annulus 36. The pressure in the upper annulus forces any slurry in the tubing 46 back up to the surface.

After the reversing circulation is performed the gravel pack integrity test is run as described and the service tool 30*b* is removed from the well via the workstring, keeping in mind that in accordance with the instant invention this is accomplished without unscrewing the service tool and without applying torque to the workstring. Once the service tool 30*b* is out, the service tubing or production string (not shown) can be run into the well 10, through the packer 30*b* and stingered into a polished packer housing seal bore (not shown). After the production string is stingered into the packer 30*b* it is in fluid communication with the blank liner and production of the formation products can be performed in a known manner.

Referring to FIGS. 2A–2F again it should be noted that removal of the service tool 30*b* results in only the basic packer housing 50 and setting assembly being left in the well. That is, the packer setting sleeve 94, the packer mandrel 60, the elements and slips 104, 106, 108, the upper and lower slip bowls 102, 110, the ratchet housing 112, ratchet ring 114, ratchet sleeve 98, lower housing 58, lower coupling 56 and the housing extensions 52 remain in the well.

Turning now primarily to FIGS. 2B, 2C, and 6–6D, the ratchet mechanism and packer release assembly will now be described. Specifically in FIGS. 2B, 2C it can be seen that prior to setting the packet 30*a*, the ratchet mandrel 98 is positioned upward in the packer. The ratchet sleeve 98 is joined to the packer setting sleeve 94 as described earlier herein. Thus, during the packer setting operation, as the sleeve 94 is forced downward, the ratchet sleeve 98 also is forced downward and ends up in the position shown in FIG. 3C after the packer is set.

As shown in FIG. 6A, the ratchet sleeve has a lower end formed with slotted ratchet finger elements 170 (only 2 shown) somewhat similar to the service tool release collet fingers 140 in that the fingers 170 can be collapsed radially inwardly although, unlike the tool release collet fingers 140, the ratchet fingers 170 are not designed or biased to naturally collapse or relax inwardly out of engagement from the ring.

The T-shaped ratchet ring 114 is retained within a recess 111 in the housing 112. As shown in FIGS. 6B and 6C the ratchet ring 114 and ratchet fingers 170 have cooperating trapping threads 172 which mesh and act to prevent upward movement of the ratchet sleeve 98. The ratchet ring is a split ring design as shown in FIG. 6D. The split 115 permits the ring 114 to compressively engage with the ratchet sleeve 98 to ensure a good mesh of the trapping threads 172. That is, the mandrel 60 and ratchet sleeve 98 expand the ring outwardly within the recess 111 to provide a positive ratcheting function as the ratchet sleeve slides downward during setting of the packer.

The teeth of the ratchet fingers 170 are held in engagement with the teeth of the ratchet ring 114 because the ratchet sleeve 98 is supported by a larger outer diameter portion 60*a* of the packer mandrel 60 (see either FIG. 2B or 3B). This is important because the packer elements 106 and slip 104 are adjacent the ratchet sleeve 98. Thus, if it were not for the packer mandrel 60, the setting load on the elements and slips 106, 104 could cause the ratchet sleeve fingers 170 to collapse out of engagement with the ratchet ring 114.

Thus, the packer setting load of the elements and slips 106, 104 is trapped between the ratchet sleeve 98 and the ratchet ring 114. The ratchet mechanism, therefore, prevents relaxation of the packer setting members after the tubing 46 setting pressure is bled off. That is, without the described ratchet mechanism, the setting sleeve 94 would tend to shift upwardly and permit the elements 106 and slips 104 to relax somewhat resulting in less of a setting load to hold the packer 30*b* in the casing.

A very useful feature of the above-described ratchet mechanism is that is can be released so as to permit an easier retrieval of the packer 30*b* after the packer is set. This it shown primarily in FIG. 6.

Situations can arise wherein it becomes necessary to release the packer from the well. The known packers are removed by applying a tremendous upward force via a workstring which is latched into the packer housing. This is a difficult and expensive operation because of the high setting load holding the packer in the casing.

Figure 6:
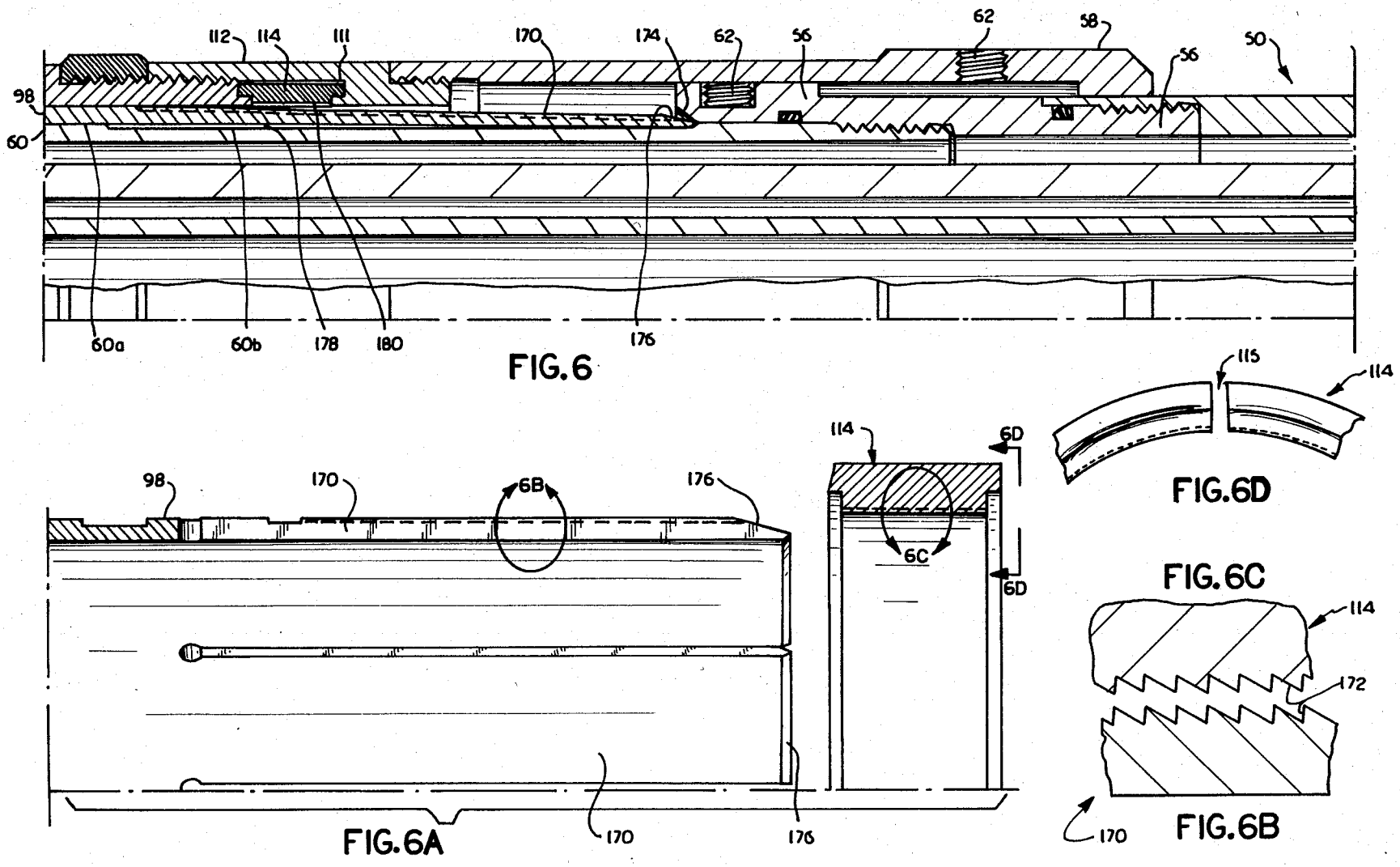
FIG. 6 is a longitudinal section of a portion of the packer and service tool assembly showing a ratchet mechanism according to the present invention just as it is being released to permit retrieval of the packer.

The present invention overcomes this problem in the following way. To retrieve the packer 30*b*, the production string (not shown) is replaced with a workstring which is latched into the packer housing 50 in a conventional manner. Once latching is confirmed the packer 30*a* is picked up with about a 70,000 pound pull above the pipe weight. As described hereinabove, the packer housing 50 is supported on the lower setting housing 58 and the packer mandrel 60 via the lower coupling 56. Since the service tool 30*b* is no longer in the well, the packer mandrel 60 can move upwardly in the well 10. Thus, the housing 50 is only restrained by the shear bolts 62 (see FIG. 3C). When the 70,000 pound pull is applied to the packer housing 50 it is sufficient to shear off the bolts 62 and a portion of the housing 50 telescopes up into the lower housing 58 as illustrated in FIG. 6 (keep in mind that the lower housing 58 is restrained from upward movement because it is coupled to the lower slip bowl 110 which is restrained by the elements and slips 106, 104 set in the casing).

The described upward movement of the packer housing 50 in turn causes upward movement of the lower coupling 56 to which it is attached. The upper end of the coupling 56 has a beveled face 174 which cams against tapered lower ends 176 of the ratchet sleeve fingers 170. In FIG. 6 the coupling 56 is shown just as it begins to cam against the fingers 170.

The packer mandrel 60 (which moves upwardly with the housing 50 and coupling 56 and may now be considered a packer mandrel assembly) has a reduced outer diameter portion 60*b* which forms a recess or depression 178 into which the fingers 170 are pushed or collapsed by the camming face 174 of the coupling 56. As the coupling 56 is pulled further upwards from the position shown in FIG. 6, the recess 178 slides up opposite the fingers 170 (as illustrated in FIG. 6) and the fingers are pushed inwardly so as to disengage the trapping threads 172 on the ratchet sleeve fingers 170 and the ratchet ring 114. Of course, the split ratchet ring 114 will tend to also collapse around the depressed fingers 170; however, the T-shape of the ring 114 catches on the housing 112 and restrains the ring 114 from collapsing back into engagement. Thus, gap 180 is present between the ring and fingers trapping teeth 172. The described inward collapse of the ratchet sleeve fingers permits the ring 108*a* to pull up on the elements 106 and releases the setting load on the elements and slips 106, 104 and the packer 30*b* can then be retrieved with a much lighter pull load.

It should be noted that when the packer is set, or prior to the packer being set, the packer mandrel recess 178 is below the setting load zone of the elements and slips 106, 104 so that the larger outer diameter of the mandrel 60 holds the ratchet mechanism engaged. Thus, the setting load is trapped by the ratchet mechanism as was previously described (see FIG. 3C). As shown in FIG. 3C, the step-up which occurs between the smaller and larger outer diameters of the mandrel 60 is approximately positioned opposite the ratchet ring 114 prior to and after setting of the packer 30*b*. This relative position of the mandrel 60 with respect to the ring 114 and setting members 106, 104 cannot change until the packer release screws 62 are sheared off. The packer mandrel 60 cannot accidentally slide up so as to have the recess 178 under the ratchet ring and sleeve during setting because the mandrel 60 is joined to the service tool 30*b* and workstring 32 via the disengageable coupling 100 during running in and setting.

Also note that the ratchet mechanism that traps the setting load on the elements and slips 106, 104 is located below the elements and slips thereby isolating the packer releasing mechanism from debris. This helps minimize releasing problems.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A packer assembly for use in oil and gas wells with a well casing, the packer assembly being removeable by pulling upwardly on a housing, comprising:

a plurality of hydraulically actuated seal and slip rings for setting the packer assembly in the well casing;

sliding means for compressing the seal and slip means against an element secured to the housing and stationary with respect to said sliding means, said sliding means moving relative to the housing under force of hydraulic pressure;

a releasable ratchet mechanism including a ratchet sleeve and a ratchet ring, the sleeve and ring having cooperating trapping teeth meshable in a ratcheting manner;

the ratchet sleeve being adapted for sliding movement with the sliding means axially through the ratchet ring which is stationarily held in the packer assembly, the ratchet sleeve being collet-shaped and including a plurality of slotted fingers which are radially moveable;

means for abutting and radially moving the slotted fingers when the housing is pulled upwardly with sufficient force to disengage the housing from its previous position;

said means for abutting and radially moving including a lower section which engages the slotted fingers, the lower section being operatively attached to the housing; and means for holding the ratchet ring substantially stationary as the slotted fingers move radially so that the cooperating trapping teeth become separated.

2. The packer assembly of claim 1 which further includes breakable means for holding the lower section in position relative to the housing.

3. A packer as set forth in claim 2, wherein a packer mandrel assembly and the lower section are moveable with respect to each of said ratchet sleeve, seal and slip means and ratchet ring after said breakable means are broken by an upward pull on the housing, said packer mandrel assembly having a first outer diameter portion and a recessed relatively smaller second outer diameter portion, said first portion substantially engaging said ratchet sleeve fingers when the packer is set so as to trap the setting load, said packer mandrel assembly moving with the lower section after said breakable means is broken so as to position said recessed second portion substantially opposite said ratchet sleeve fingers thereby permitting said ratchet sleeve fingers to collapse inwardly.

4. A packer as set forth in claim 3, wherein said packer mandrel assembly includes a cam element engageable with free ends of said ratchet sleeve fingers as said packer mandrel assembly moves with respect to said ratchet sleeve, said cam elements causing said fingers to collapse inwardly thereby releasing said ratchet mechanism.

5. A packer as set forth in claim 4, wherein said ratchet ring is a split T-shaped ring which is adapted to collapse from a first outer diameter to a second relatively smaller outer diameter, said ratchet ring being held at said first outer diameter by engagement with said ratchet sleeve when said packer mandrel assembly first portion is abutting said ratchet sleeve so as to ensure a positive ratcheting engagement with said ratchet sleeve fingers, said ratchet ring collapsing to said second outer diameter when said ratchet sleeve fingers are cammed and collapsed inwardly, said second outer diameter being great enough to prevent said ratchet ring from engaging said collapsed ratchet sleeve fingers in a ratcheting manner.

6. A packer as set forth in claim 5, wherein said ratchet ring is held in a ring housing member of the packer held by said seal and slip means, said ring housing preventing said ratchet ring from collapsing inwardly to an outer diameter less than said second outer diameter.

* * * * *